US008066491B2

(12) United States Patent
Nguyen et al.

(10) Patent No.: US 8,066,491 B2
(45) Date of Patent: Nov. 29, 2011

(54) RECIPROCATING PUMP WITH ELECTRONICALLY MONITORED AIR VALVE HAVING BATTERY AND SOLENOID ELECTRONIC MONITORING

(75) Inventors: Vu K. Nguyen, Brooklyn Park, MN (US); David M. Behrens, Hopkins, MN (US); Christopher M. Lange, New Brighton, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 982 days.

(21) Appl. No.: 11/996,410

(22) PCT Filed: Jul. 26, 2006

(86) PCT No.: PCT/US2006/028989

§ 371 (c)(1),
(2), (4) Date: Jan. 22, 2008

(87) PCT Pub. No.: WO2007/016151

PCT Pub. Date: Feb. 8, 2007

(65) Prior Publication Data

US 2008/0206066 A1 Aug. 28, 2008

Related U.S. Application Data

(60) Provisional application No. 60/703,595, filed on Jul. 29, 2005.

(51) Int. Cl.

| | |
|---|---|
| ***F04B 49/00*** | (2006.01) |
| ***F04B 49/06*** | (2006.01) |
| ***G05D 13/10*** | (2006.01) |
| ***F01L 25/08*** | (2006.01) |

(52) U.S. Cl. ..... 417/12; 417/46; 417/53; 417/63; 91/248; 137/50

(58) Field of Classification Search ..... 417/12, 417/46, 53, 63; 137/47, 50; 91/248
See application file for complete search history.

(56) References Cited

U.S. PATENT DOCUMENTS

| | | | | |
|---|---|---|---|---|
| 3,813,596 | A * | 5/1974 | Hulls | 324/391 |
| 4,300,603 | A * | 11/1981 | Laub, III | 141/258 |
| 4,321,946 | A | 3/1982 | Paulos et al. | |
| 4,964,014 | A | 10/1990 | Boe et al. | |
| 4,990,058 | A * | 2/1991 | Eslinger | 417/46 |
| 5,008,773 | A | 4/1991 | Yoshida et al. | |
| 5,583,434 | A | 12/1996 | Moyers et al. | |
| 5,748,431 | A | 5/1998 | Goodnight et al. | |
| 5,790,364 | A | 8/1998 | Mikami et al. | |
| 6,152,172 | A * | 11/2000 | Christianson et al. | 137/554 |
| 6,384,573 | B1 | 5/2002 | Dunn | |
| 6,693,787 | B2 | 2/2004 | Kolmanovsky et al. | |
| 2002/0017325 | A1 | 2/2002 | Becker | |
| 2003/0088338 | A1 | 5/2003 | Phillips et al. | |
| 2003/0234050 | A1 * | 12/2003 | Misumi | 137/554 |
| 2008/0092960 | A1 * | 4/2008 | Manecke et al. | 137/554 |

* cited by examiner

*Primary Examiner* — Charles Freay
(74) *Attorney, Agent, or Firm* — Douglas B. Farrow

(57) ABSTRACT

An air operated pump (10) uses a magnet (14) mounted in the valve cup (16) of the air motor (18) and two reed sensors (20) mounted in the valve cover (22) to monitor the speed and position of the valve (16). A solenoid (24) is mounted on the valve cover (22) and can be commanded to extend a plunger (26) into the valve cup (16) to stop valve movement and therefore the pump from running away. Three methods may be used to increase battery life and monitor the solenoid plunger position, two of which use the changing inductance of the solenoid (24) to monitor the solenoid movement.

3 Claims, 5 Drawing Sheets

RECIPROCATING PUMP WITH ELECTRONICALLY MONITORED AIR VALVE HAVING BATTERY AND SOLENOID ELECTRONIC MONITORING

This application claims the benefit of U.S. Application Ser. No. 60/703,595, filed Jul. 29, 2005.

TECHNICAL FIELD

Background Art

Air-operated reciprocating piston pumps are well known for the pumping of various fluids. Such pumps typically have mechanically or pneumatically operated air valves to control the flow of air to the two sides of the piston. Control of such pumps has traditionally been by monitoring and controlling the resulting fluid flow rather than the pump itself. Prior art devices such as Graco's EXTREME-MIX™ proportioner have monitored the position of the piston for purposes of control.

DISCLOSURE OF THE INVENTION

It is therefore an object of this invention to provide a system which allows enhanced monitoring and control of a reciprocating air motor so as to allow monitoring of piston position, cycle and flow rates, total cycles, runaway control and the ability to diagnose failing air motor and pump lower components.

The control uses a magnet mounted in the valve cup of the air motor and two reed sensors mounted in the valve cover to monitor the speed and position of the valve. A solenoid is mounted on the valve cover and can be commanded to extend a plunger into the valve cup to stop valve movement and therefore the pump from running away (typically caused by the fluid supply being empty.) The user interface comprises an LCD and buttons to set up and control the pump. The display can be toggled to display cycle rate, flow rate (in various units), total cycles and diagnostic errors. Setup parameters can include fluid units (quarts, liters, etc.) and the runaway set point.

The reed switches and magnets are located so as to detect when the air valve is at the extreme position of each stroke or in transition or both. The controller calculates the rate at which the motor is running by counting the opening and closing of the reed switches activated by the varying positions of the air valve. The controller then compares that rate to a pre-programmed value to determine if the air motor is in a runaway condition. The that condition is present, the controller activates the solenoid preventing changeover which stops the motor. This acts to prevent spilled fluid and/or pump damage.

Three methods may be used to increase battery life and monitor the solenoid plunger position, two of which use the changing inductance of the solenoid to monitor solenoid movement.

In the first method, the controller software monitors the voltage curve of the solenoid as the solenoid is energized. When the solenoid plunger reaches the end of its stroke, the software stops the voltage pulse.

In the next embodiment, the controller software monitors the voltage curve of the solenoid as the solenoid is energized. If a voltage spike is not present at the end of the voltage curve (in a fixed amount of time), the controller software will know that the solenoid did not latch and thus did not complete its required movement.

In the final embodiment, voltage is measured across the solenoid as a voltage pulse is applied to determine if the current battery voltage level is sufficient to activate the solenoid.

These and other objects and advantages of the invention will appear more fully from the following description made in conjunction with the accompanying drawings wherein like reference characters refer to the same or similar parts throughout the several views.

BEST MODE FOR CARRYING OUT THE INVENTION

Figure 1:
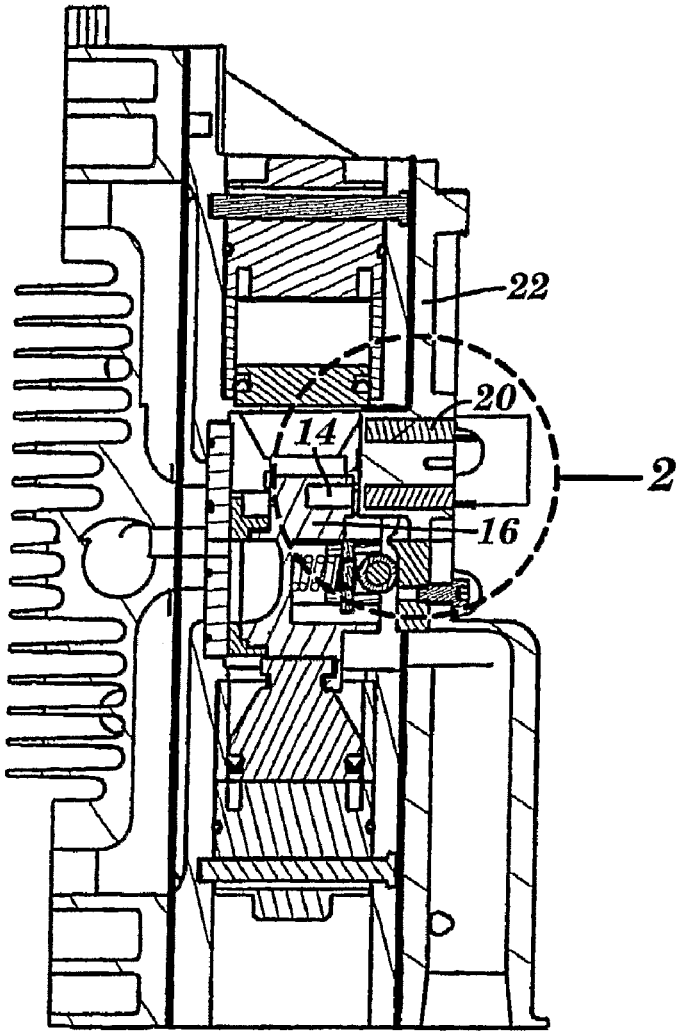
FIG. 1 shows a cross-section of the air valve as part of the instant invention showing the magnets and reed switches.
Figure 2:
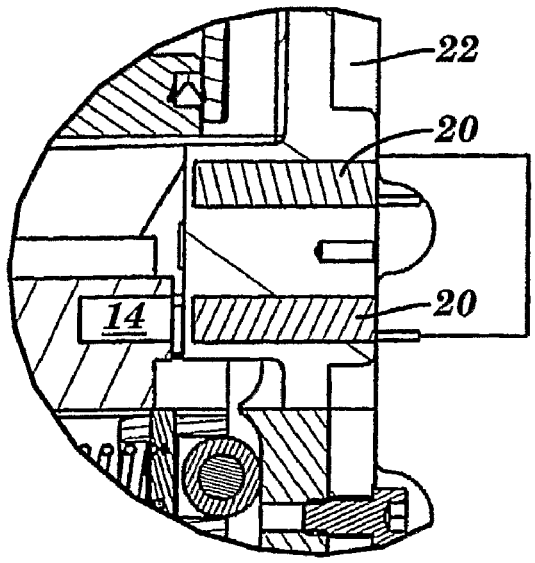
FIG. 2 shows a detail of the FIG. 1 cross-section of the air valve as part of the instant invention.
Figure 3:
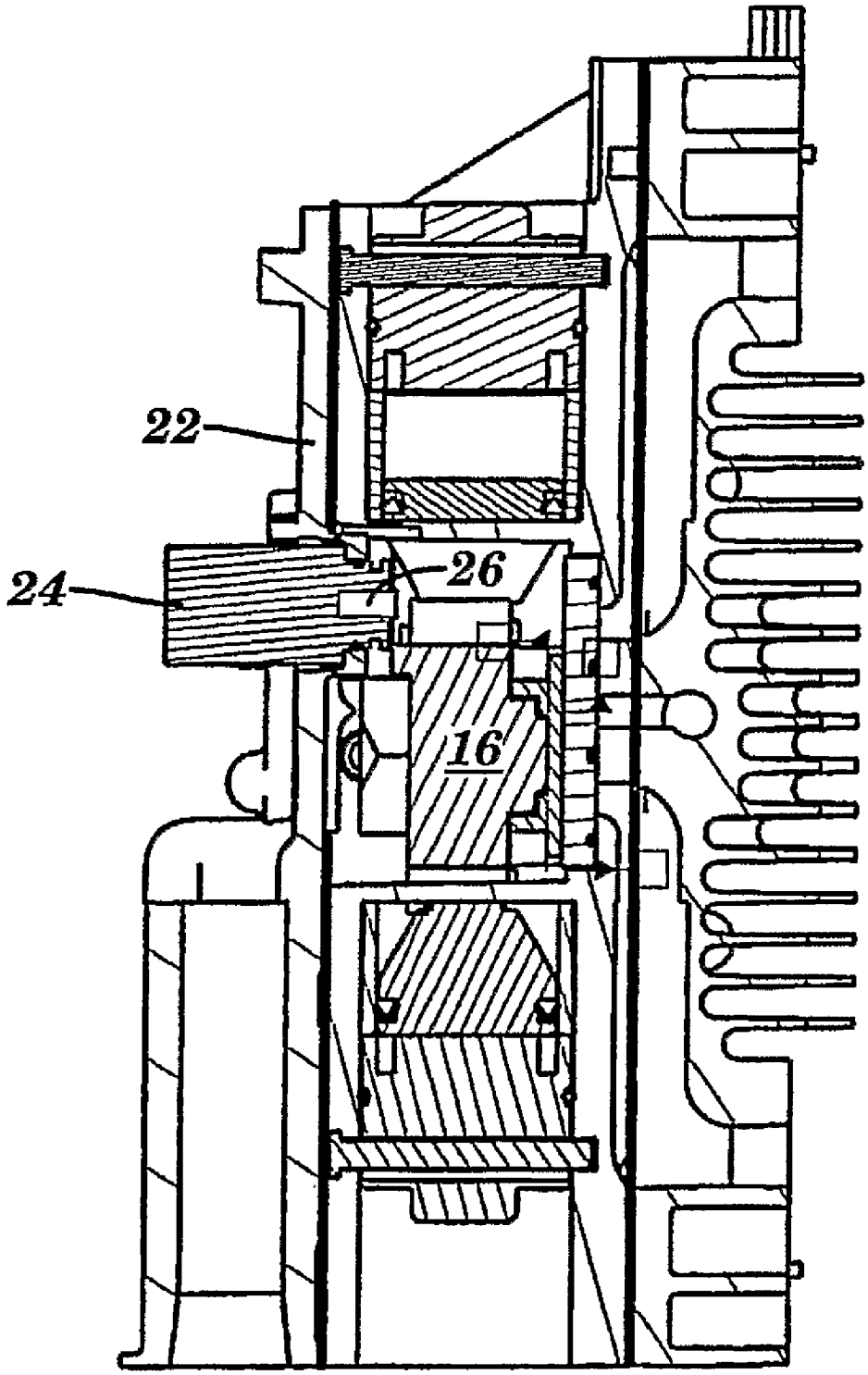
FIG. 3 shows a cross-section (opposite that of FIG. 1) of the air valve as part of the instant invention showing the solenoid.
Figure 4:
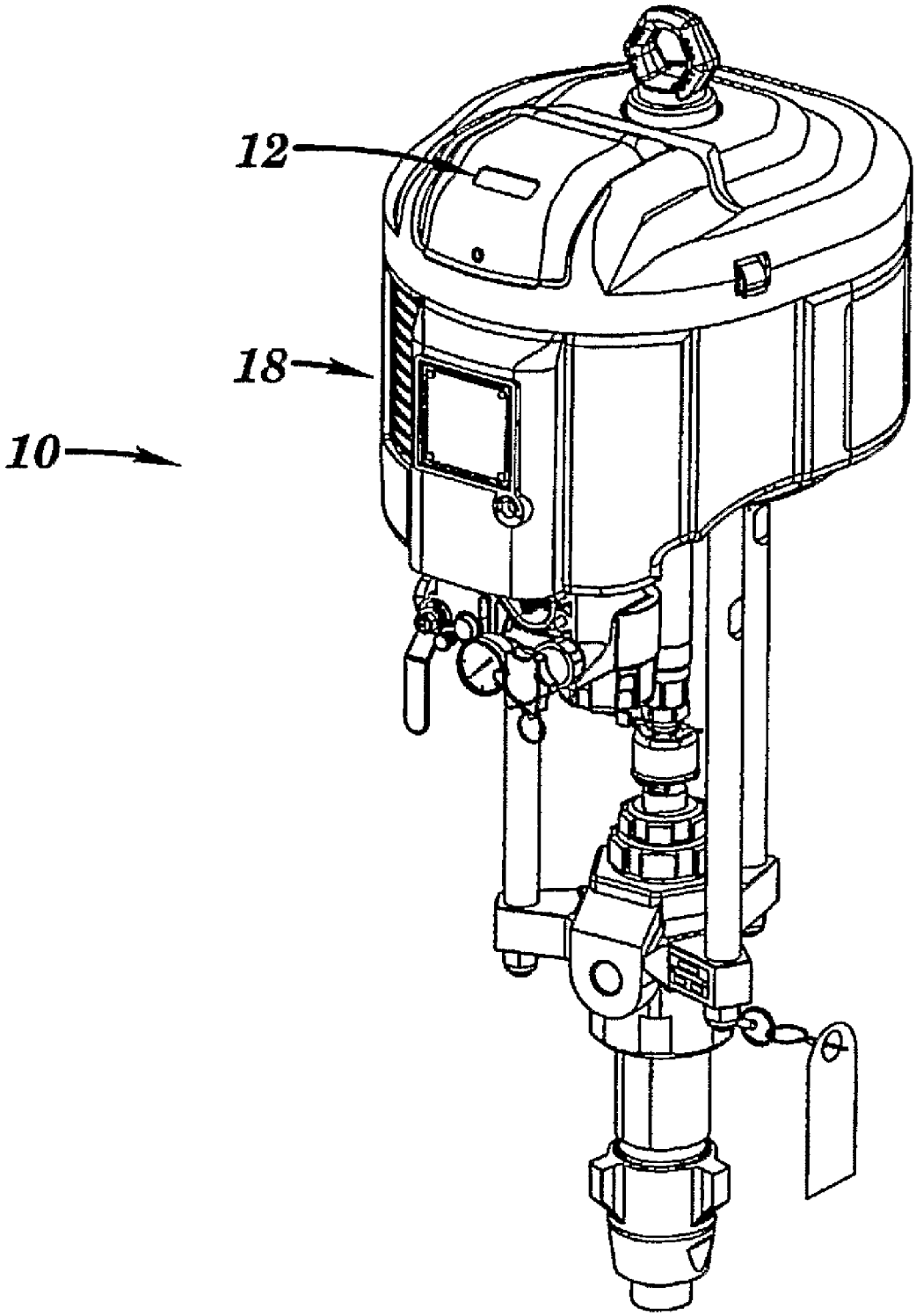
FIG. 4 shows a view of a pump incorporating the instant invention.
Figure 5:
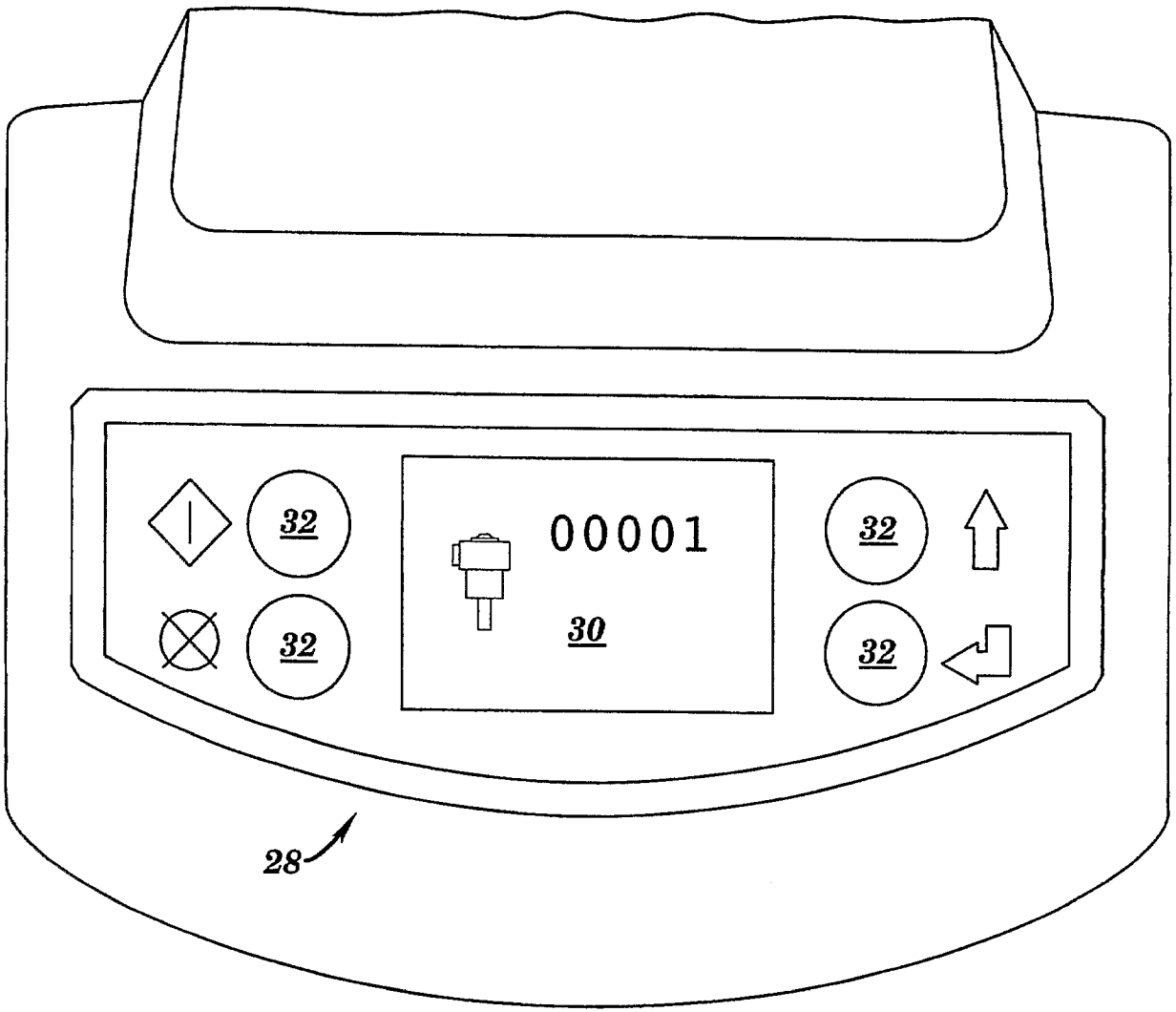
FIG. 5 shows a detail of the user interface of the instant invention.
Figure 6:
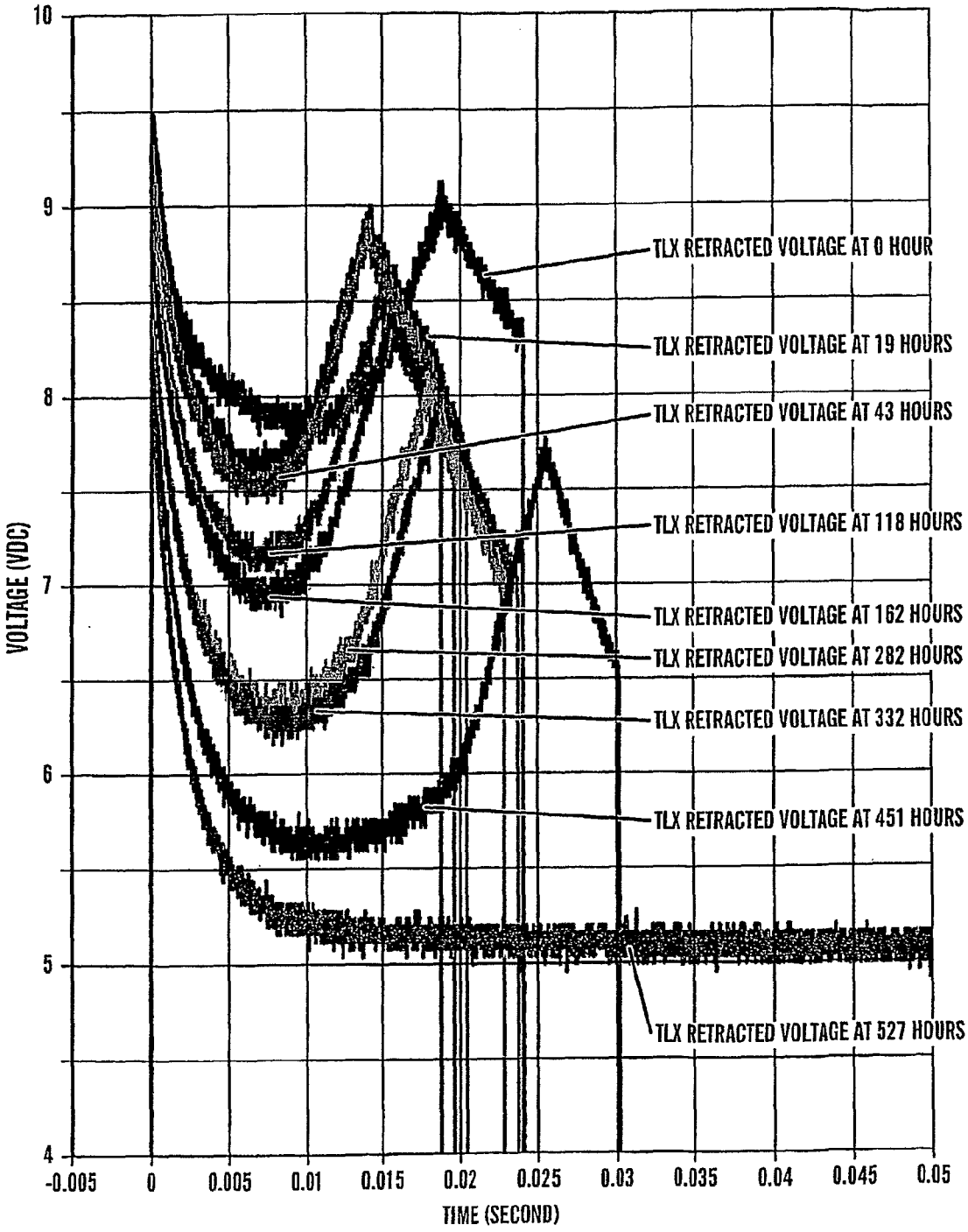
FIG. 6 shows typical voltage drops over time.

In an air-operated reciprocating piston pump 10, the controller 12 uses a magnet 14 mounted in the valve cup 16 of the air motor 18 and two reed sensors 20 mounted in the valve cover 22 to monitor the speed and position of the valve 16. A solenoid 24 is mounted on the valve cover 22 and can be commanded to extend a plunger 26 into the valve cup 16 to stop valve movement and therefore the pump 10 from running away (typically caused by the fluid supply being empty or the hose of other supply conduit having a leak/rupture.) The user interface 28 comprises an LCD display 30 and buttons 32 to set up and control the pump 10. The display 30 can be toggled to display cycle rate, flow rate (in various units), total cycles and diagnostic errors. Setup parameters can include fluid units (quarts, liters, etc.) and the runaway set point.

The reed switches 20 and magnets 14 are located so as to detect when the air valve 16 is at the extreme position of each stroke or in transition or both. The controller 12 calculates the rate at which the motor 18 is running by counting the opening and closing of the reed switches 20 activated by the varying positions of the air valve 16. The controller 12 then compares that rate to a pre-programmed value to determine if the air motor 18 is in a runaway condition. The that condition is present, the controller 12 activates the solenoid 24 preventing changeover which stops the motor 18. This acts to prevent spilled fluid and/or pump damage.

Three methods may be used to increase battery life and monitor the solenoid plunger position, two of which use the changing inductance of the solenoid to monitor solenoid movement.

In the first method, the controller 12 software monitors the voltage curve of the solenoid 24 as the solenoid is energized. When the solenoid 24 plunger reaches the end of its stroke, the software stops the voltage pulse.

In the next embodiment, the controller software monitors the voltage curve of the solenoid 24 as the solenoid 24 is energized. If a voltage spike is not present at the end of the voltage curve (in a fixed amount of time), the controller software will know that the solenoid 24 did not latch and thus did not complete its required movement.

In the final embodiment, voltage is measured across the solenoid 24 as a voltage pulse is applied to determine if the current battery voltage level is sufficient to activate the solenoid 24.

It is contemplated that various changes and modifications may be made to the pump control without departing from the spirit and scope of the invention as defined by the following claims.

The invention claimed is:

1. A method of controlling an air operated pump having an air valve with an valve cup and a valve cover comprising:

providing a magnet mounted in said valve cup of said air valve and first and second reed sensors mounted in the valve cover to monitor the speed and position of the valve, and a solenoid having a voltage curve and a plunger and being mounted on said valve cover, said solenoid being capable of extending said plunger into said valve cup with a voltage pulse to stop valve movement;

monitoring the voltage curve of said solenoid as the solenoid is energized; and stopping said voltage pulse when said solenoid plunger reaches the end of its stroke.

2. A method of controlling an air operated pump having an air valve with an valve cup and a valve cover comprising:

providing a magnet mounted in said valve cup of said air valve and first and second reed sensors mounted in the valve cover to monitor the speed and position of the valve, and a solenoid having a voltage curve and a plunger and being mounted on said valve cover, said solenoid being capable of extending said plunger into said valve cup with a voltage pulse to stop valve movement;

monitoring the voltage curve of said solenoid as the solenoid is energized over a fixed period of time for a voltage spike; and providing an alarm if said spike does not occur in said fixed period of time.

3. A method of controlling an air operated pump having a battery with a voltage level, an air valve with an valve cup and a valve cover comprising:

providing a magnet mounted in said valve cup of said air valve and first and second reed sensors mounted in the valve cover to monitor the speed and position of the valve, and a solenoid having a voltage curve and a plunger and being mounted on said valve cover, said solenoid being capable of extending said plunger into said valve cup with a voltage pulse to stop valve movement;

monitoring the voltage curve of said solenoid as the solenoid is energized to determine if the current battery voltage level is sufficient to activate said solenoid; and providing an alarm if said battery voltage level is insufficient to activate said solenoid.

* * * * *